United States Patent [19]

Davies et al.

[11] 3,950,967

[45] Apr. 20, 1976

[54] COLOURATION PROCESS

[75] Inventors: Johnson York Davies; Guillaume Ward Jamin; Thomas Renshaw; Roy Anthony Saunders; Geoffrey Taylor, all of Manchester, England; John Prys Williams, Col Roma, Mexico

[73] Assignee: Imperial Chemical Industries Limited, London, England

[22] Filed: Jan. 25, 1974

[21] Appl. No.: 436,791

[30] Foreign Application Priority Data

Jan. 31, 1973 United Kingdom ..... 4768/73

[52] U.S. Cl. ..... 68/5 D; 239/565

[51] Int. Cl.[2] ..... D06B 1/08

[58] Field of Search ..... 68/5 R, 5 A, 5 B, 5 C, 68/5 D, 5 E, 207, 183, 6; 8/149.2; 118/48–49, 68, 302; 239/565

[56] References Cited

UNITED STATES PATENTS

| | | | |
|---|---|---|---|
| 1,683,687 | 9/1928 | Mijer | 8/149.2 |
| 1,907,429 | 5/1933 | Masland | 68/5 D X |
| 1,948,568 | 2/1934 | Faber | 68/5 C |
| 2,218,811 | 10/1940 | Chaussabel | 68/205 R |
| 2,219,830 | 10/1940 | Whisenhunt | 68/5 B |
| 3,050,416 | 8/1962 | Yahnke | 118/302 |
| 3,570,275 | 3/1971 | Weber et al. | 68/183 X |
| 3,762,866 | 10/1973 | Rayment et al. | 68/5 C X |

*Primary Examiner*—Peter Feldman
*Assistant Examiner*—Philip R. Coe
*Attorney, Agent, or Firm*—Cushman, Darby & Cushman

[57] ABSTRACT

An apparatus for the colouration of textile materials with a gaseous stream containing a dyestuff, or dyestuffs, in vapour form, which comprises means for passing a hot stream of inert gas over a dyestuff and means for allowing the resulting stream of gas containing dyestuff vapour to impinge on the textile material, in particular an apparatus comprising a reservoir for containing an inert gas under pressure, said reservoir being connected to a tube fitted with heaters, said tube containing a receptacle for the dyestuff, and the other end of the tube being fitted with a jet from which issues the stream of inert gas containing a dyestuff vapour. The apparatus is preferably used for colouring synthetic textile materials with volatile Disperse Dyestuffs.

5 Claims, 8 Drawing Figures

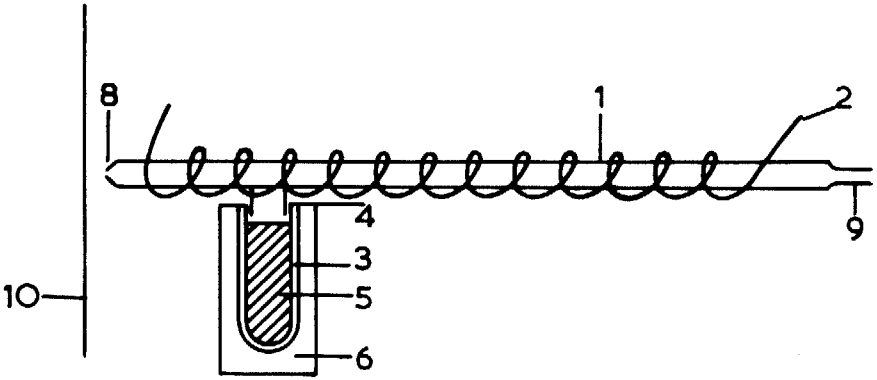
FIGURE I

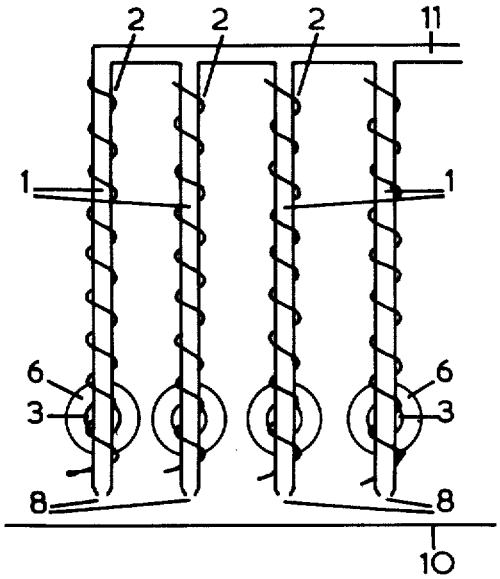
FIGURE II

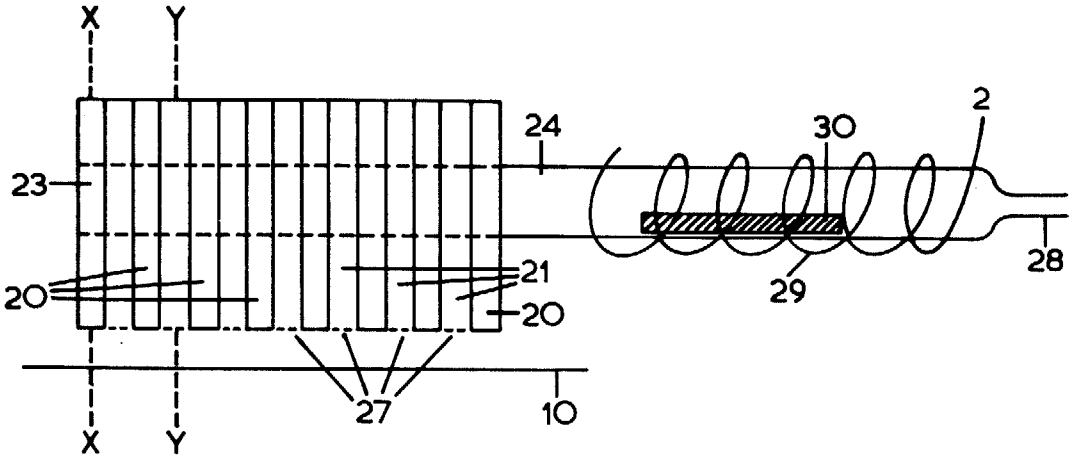
FIGURE III
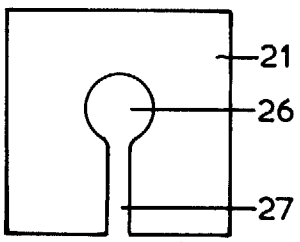
FIGURE V
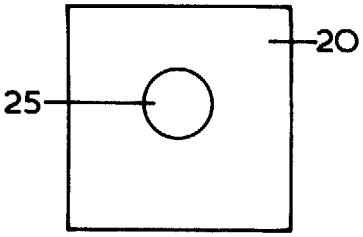
FIGURE IV

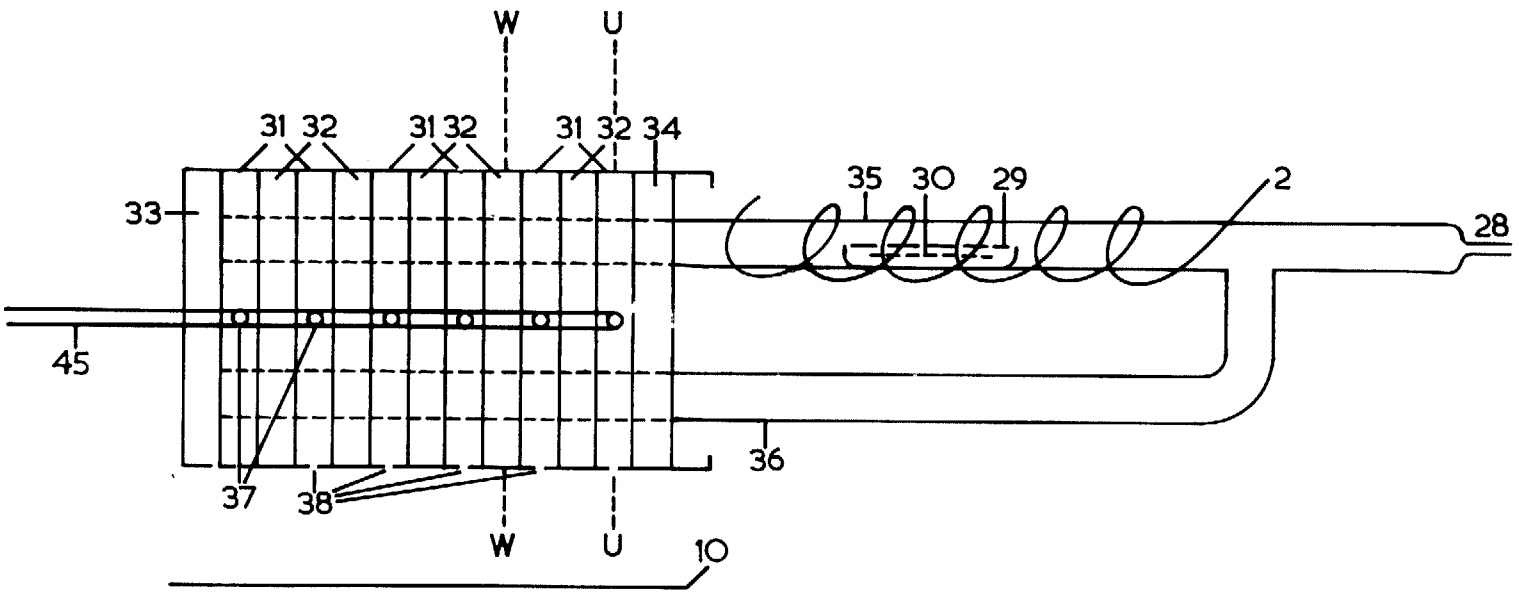
FIGURE VI

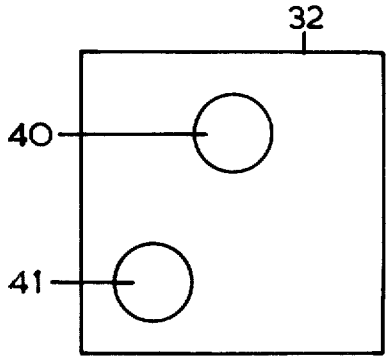
FIGURE VII
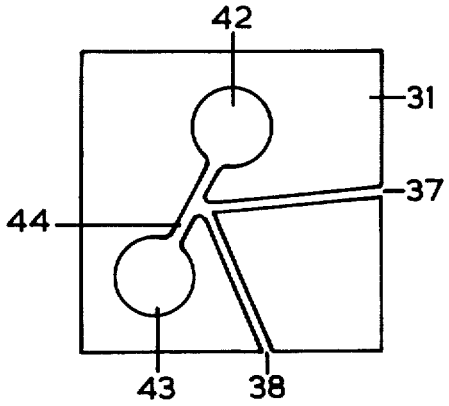
FIGURE VIII

COLOURATION PROCESS

The invention relates to an apparatus for colouring textile materials.

According to the invention there is provided an apparatus for the colouration of textile materials with a gaseous stream containing a dyestuff, or dyestuffs, in vapour form, which comprises means for passing a hot stream of inert gas over a dyestuff and means for allowing the resulting stream of gas containing dyestuff vapour to impinge on the textile material.

The apparatus preferably comprises a reservoir for containing an inert gas, such as nitrogen, air or dry steam, under pressure connected to a tube fitted with heaters and which contains a receptacle for the dyestuff, the other end of the tube being fitted with a jet the exit of which is in close proximity to a piece of textile material.

In operating the apparatus just described a dyestuff is placed in the receptacle in the tube, a stream of gas is passed through the tube by opening a valve on the reservoir, and the heaters on the tube are then switched on until the required working temperature is reached. The hot stream of inert gas containing the dyestuff vapour which emerges from the jet is then allowed to impinge on the textile material which is then coloured at this point. By suitable movement of the textile material a coloured pattern can be obtained on the textile material. Alternatively, if the apparatus is portable the colour pattern can be obtained by moving the apparatus relative to the textile material.

In order to increase the volatility of the dyestuff, and hence increase the concentration of dyestuff vapour in the gaseous stream it is preferred to also heat the dyestuff, preferably to a temperature in the region of 150°C to 250 °C. The stream of the inert gas is preferably heated to a temperature in the same range. The resulting stream of inert gas containing the dyestuff vapour is absorbed by the textile material and is simultaneously fixed thereon due to the heat imparted to the textile material from the hot gas stream. If the hot gas stream is unable to heat the textile material to a temperature at which fixation of the dyestuff takes place then this difficulty can be overcome by pre-heating the textile material so that its cooling effect on the gas stream is minimised thus enabling the temperature of fixation to be reached. While it is preferable to use as hot a gas stream as is possible, the temperature must not be such as will cause undue decomposition of the dyestuff and/or damage to the textile material.

As an alternative to passing the hot stream of inert gas over the dyestuff, the dyestuff either in the form of finely-divided solid or in the form of a dispersion or a solution in a suitable liquid can be injected into the hot stream of inert gas.

In order that the dyestuff has the necessary affinity for the textile material it is essential that the dyestuff should be of the type which is cutomarily employed in colouring the textile material. Further, in order that the dyestuff has the necessary degree of volatility, thus enabling a sufficient concentration of dyestuff vapour to be obtained in the gas stream, the dyestuff should be of a type which vaporises to a sufficient extent at the temperature employed in the process. Dyestuffs which have this property are generally those which are referred to as Disperse Dyestuffs which are customarily employed for colouring synthetic textile materials, so that the apparatus is primarily intended for colouring synthetic textile materials with a hot gaseous stream containing the vapour of one or more Disperse Dyestuffs.

The Disperse Dyestuffs can be of any of the recognised classes of Disperse Dyestuffs, in particular of the azo, anthraquinone or nitro series such as are described in, for example, the third edition of the Colour Index which was published in 1971. Such dyestuffs can either be used in their commercially available forms which contain quantities of dispersing agents or other diluents, but if desired such dyestuffs can be used in concentrated form, i.e. in which little or no dispersing agents and/or diluents are present. Preferably the Disperse Dyestuffs fall within the categories of Class A and Class B Disperse Dyestuffs (this classification being based on a combination of dyeing properties and fastness to dry heat) and are described in the Journal of the Society of Dyers and Colourists 1969 at pages 606 to 613 and in Technical Information Note D.1055 titled "Synthetic Fibre Dyeing — Classification of disperse dyes according to dyeing and heat fastness properties"- which was published by Imperial Chemical Industries Limited in 1968.

As examples of synthetic textile materials there may be mentioned cellulose acetate, such as secondary cellulose acetate and cellulose triacetate, textile materials, synthetic polyamide such as Nylon 6:6 and Nylon 6 textile materials, polyacrylonitrile textile materials, polyurethane textile materials, and preferably aromatic polyester textile materials such as polyethylene terephthalate textile materials. Such textile materials can be in the form of fibres or filaments or woven or knitted goods. If desired the synthetic textile materials can be in the form of unions with other textile materials in particular woolen or cotton goods but in this case it is preferred that the synthetic textile material constitutes at least 70 percent by weight of the goods. In place of the synthetic textile materials there can also be used synthetic materials in the form of webs or films or there can be used materials such as wood, metal or plasterboard which are coated with a film of a synthetic material which has an affinity for Disperse Dyestuffs.

FIG. I is a side view of a colourizing apparatus embodying the principles of the present invention;

FIG. II is a plan view of a second embodiment of the apparatus;

FIG. III is a side view of a third embodiment;

FIGS. IV and V are sectional views taken on the lines X—X and Y—Y, respectively, of FIG. III;

FIG. VI is an end view of a fourth embodiment; and

FIGS. VII and VIII are sectional views taken on the lines W—W and U—U, respectively of FIG. VI.

A preferred form of the apparatus will now be described with particular reference to FIG. I of the accompanying drawings which represents a side-view of the apparatus.

The apparatus consists of a tube 1 surrounded by an electric heating element 2. Attached to the tube 1 by a threaded joint 4 is a receptacle 3 for the dyestuff 5. The receptacle 3 being contained in a heater 6. Attached to one end of the tube 1 is a jet 8, while the other end of the tube 1 is attached by the pipe 9 to a source of an inert gas, such as a cylinder of nitrogen (not shown). In operating this apparatus, the dyestuff 5 is placed in the receptacle 3 which is then connected to the tube 1 by the threaded joint 4. A stream of the inert gas is then passed through the tube, the heaters 2 and 6 are switched on, and when the inert gas issuing from the jet 8 contains dyestuff vapour, a piece of textile material 10 is placed in close proximity to the jet 8 so that the stream of inert gas impinges on the textile material. By moving the textile material 10 relative to the position of the jet 8 a coloured pattern can be produced on the textile material. If desired a shutter can be inserted into the apparatus between the threaded joint 4 and the outlet of the jet 8 so that the stream of gas carrying the dyestuff vapour can be shut off thus permitting further variations in the design of the pattern produced on the textile material.

Since the jet 8 is generally of narrow diameter the pattern produced on the textile material generally consists of a somewhat narrow line, and in order that the textile material can be coloured across its full width a number of the said apparatus are used together, these being assembled in a row across the width of the textile material, and as the textile material is moved past the assembled row continuous coloured lines are produced along the length of the textile material. If the individual units making up the row are sufficiently close to each other then the coloured lines merge together so that an overall colouration is produced on the textile material.

According to a further feature of the present invention there is provided an apparatus for producing uniform colourations on textile materials during relative movement between the apparatus and the textile material, comprising a row of colouration units disposed transversely to said direction of relative movement, each unit being fitted with an orifice, a receptacle for the dyestuff and an inlet connected to an inert gas container, and being fitted with means for heating the unit, said units being so disposed that the stream of inert gas containing dyestuff vapour issuing from each orifice merge together to form a continuous line extending across the width of the textile material.

In order to achieve a uniform colouration across the width of the textile material it is preferred that the stream of gas issuing from each orifice in the row is at the same temperature and also is at the same pressure and this latter requirement can be effected by connecting all the units in the row to a single inert gas container.

A preferred form of such an apparatus will now be described with particular reference to FIG. II of the accompanying drawings which represents a view of the apparatus from above.

The apparatus consists of a row of parallel tubes 1, each of which is connected at one end to a common manifold 11 which is itself connected to an inert gas reservoir (11*a*). The other end of each of the tubes 1 terminates in a jet 8. Attached to each of the tubes in a vertical position is a receptacle 3 for the dyestuff, said receptacle being surrounded by a heater 6 while each of the tubes 1 is surrounded by a heater 2. A continuous length of textile material 10 is attached to rollers (10*a* and 10*b*) so adapted that the textile material can be passed in continuous manner from one roller to the other in close proximity to the jets 8, the line of tubes 1 extending across the full width of the textile material. To operate the apparatus just described, dyestuff is placed in each of the receptacles 3, inert gas is admitted into the apparatus through the manifold 11 and the heaters 2 and 6 are all switched on. When the inert gas issuing from each of the jets 8 contains dyestuff vapour the rollers are set in motion gradually drawing the textile material past the jets so that a uniform colouration is obtained on the textile material. Instead of placing the same dyestuff in each of the different receptacles 3, different dyestuffs can be used in which case a striped colouration is obtained with the stripes extended along the length of the textile material.

If desired, shutters can be inserted in the tubes 1 between the jets 8 and the dyestuff receptacles 3 so as to interupt the flow of the inert gas issuing from the jets as, by the use of such shutters, bands of colour separated by white bands can be obtained across the width of the textile material.

A further preferred form of the apparatus will now be described with particular reference to FIGS. III, IV and V of the accompanying drawings in which FIG. III represents an end view of the apparatus, and FIGS. IV and V are cross-sections respectively of Sections X—X and Y—Y of FIG. III.

The apparatus consists of a series of alternating laminates 20 and 21, one end of the series ending in a blank plate 23 and the other end in a plate 20 which has attached to it a tube 24, the laminates being firmly held together for example by a suitable adhesive or by clamps. The laminates 20 each consist of a plate containing a hole 25, while the laminates 21 each consist of a plate containing a hole 26 and a slot 27, the cross-sections of the holes 25 and 26 corresponding to that of the tube 24. The tube 24 is surrounded by a heater 2 and terminates in a connection 28 which is connected to an inert gas reservoir (not shown). Within the tube 24 is a container 29 for the dyestuff 30. In this apparatus the holes 25 and 26 in the laminates 20 and 21 form a manifold connected to the tube 24 and the slots 27 form the jets. In operating this apparatus a stream of inert gas is passed through the tube 24, the heaters 2 are switched on and when the streams of inert gas issuing from the jets 27 contain dyestuff vapour a piece of textile material is continuously drawn past the jets 27 and in close proximity thereto whereby the textile material is continuously coloured in an overall shade. The number of the alternating laminates 20 and 21 which make up the apparatus will depend on the width of the textile material which is to be coloured.

The apparatus described under FIG. III is particularly suitable for adaptation so that it can be operated in a controlled sequence using the principle of fluidics, and a form of such an apparatus employing one such principle will now be described with particular reference to FIG. VI which represents an end view of the apparatus and FIGS. VII and VIII which respectively represent cross-sections of Section W—W and U—U of FIG. VI.

The apparatus consists of a series of alternating laminates 31 and 32, one end of the series ending in a blank plate 33 and the other end in a plate 34 which has attached to it two tubes 35 and 36, the laminates being firmly held together for example by a suitable adhesive or by clamps. The laminates 32 each consist of a plate containing two holes 40 and 41. The laminates 31 each consist of a plate containing two holes 42 and 43, the cross-section of the holes 40 and 42 corresponding to that of the tube 35 whilst the cross-sections of the holes 41 and 43 correspond to that of the tube 36. In the laminate 31 the two holes 42 and 43 are connected together by a slot 44 and running from the slot 44 to two different edges of the laminate are slots 37 and 38. The tube 35 is surrounded by a heater 2 and terminates in a connection 28 which is connected to an inert gas reservoir (not shown). Within the tube 35 is a container 29 for the dyestuff 30. The tube 36 is connected to the tube 35 at a point between the connection 28 and the dyestuff container 29, and the tube 36 preferably contains a non-return valve so that the inert gas entering tube 35 cannot directly enter tube 36. In this apparatus the holes 40 and 42 together form a manifold for supplying a gas stream to the slsots 38 which form the jets, whilst the holes 41 and 43 together form a return manifold. The slots 37 are connected to a manifold which is connected to a control system (not shown) designed to emit pulses of an inert gas under pressure in response to a pre-arranged signal. In operating this apparatus a stream of inert gas is passed through the tube 35 and the heaters 2 are switched on so that the stream of inert gas becomes charged with dyestuff vapour. The stream of gas then passes along the manifold formed by the holes 40 and 42 and into the slots 44 where it enters the slots 38 which act as the jets for the apparatus and then impinge on the textile material 10 which is in close proximity to the slots 38 at their exit from the laminates 31. However, in response to the pulses of inert gas from the control system which enter the manifold 45 and then the slots 37 the inert gas stream containing the dyestuff vapour is diverted from the slots 38 into the manifold formed by the holes 41 and 43 and thence returns via the tube 36 into the tube 35 where it recirculates in the apparatus. Accordingly, when the pulses operated, dyestuff vapour is no longer issuing from the slots 38 so that the textile material which is passing the slots 38 at this time remains uncoloured. The series of laminates extends across the full width of the textile material so that as the textile material is continuously drawn past the slots 38 it is coloured in a pattern (consisting of coloured and uncoloured areas) corresponding to the pulses issued by the control system. The control arrangement just described will give the same pattern, either coloured or uncoloured, across the full width of the textile material, but by connecting each of the slots 37 to a separate control system variations in the pattern can be obtained across the width of the textile material.

Since the series of laminates in this apparatus is connected to a single source of dyestuff vapour the apparatus just described will only give one colour on the textile material. However, by using more than one series of laminates, each of which is connected to a different source of dyestuff vapour, patterns in two or more colours (in addition to the uncoloured areas) can be readily obtained on the same piece of textile material.

In order to prevent undesirable cooling of the inert gas stream containing the dyestuff vapour within the series of laminates thus resulting in deposition of solid dyestuff within the manifolds or the tubes, the said series of laminates is preferably surrounded by a heater.

It will be understood that details of the various apparatus which have been described may be varied without departing from the essential characteristics of the invention. Neither have details been given of the various materials which can be used to construct the various parts of the apparatus. Thus in the case of those parts of the apparatus which contain the dyestuff vapour (such as the tubes 1 and the various laminates) the only requirement is that they are constructed of materials which are not corroded by the dyestuff vapour and will withstand the temperature involved.

We claim:

1. An apparatus for the colouration of textile materials with a gaseous stream containing a dyestuff in vapour form, which comprises a reservoir containing an inert gas under pressure connected to a tube fitted with heaters, said tube being in communication with a receptacle for the dyestuff, and one end of the tube being fitted with a jet the exit of which is in close proximity to the piece of textile material which is to be coloured.

2. An apparatus as claimed in claim 1 which additionally contains means for transporting the textile material past the exit of the jet.

3. An apparatus as claimed in claim 2 for producing uniform colourations on textile materials during relative movement between the apparatus and the textile material comprising a plurality of colouration units, as described in claim 1, disposed in a row which extends transversely to the direction of movement of the textile material, said units being so disposed that the stream of inert gas containing dyestuff vapour issuing from each jet merge together to form a continuous line extending across the width of the textile material.

4. An apparatus for the colouration of textile materials with a dry inert gaseous stream containing a dyestuff in vapour form, which comprises:

at least one tube having one end fitted with a jet nozzle the exit of which is to be placed in close proximity to a piece of textile material which is to be colored;

means for supplying a dry inert gas, connected to the other end of said tube;

heating means fitted to the tube for heating said tube; and a dyestuff receptacle connected to said tube so as to allow the surface of the dyestuff to be in communication with the interior of said tube and said inert dry gas.

5. Apparatus for the colouration of textile materials with a volatile dyestuff comprising: a receptacle, sealed from the atmosphere, for holding a quantity of a volatile dyestuff; means for heating the dyestuff in the receptacle in order to vaporize a portion of the dyestuff; means for mixing the dyestuff vapor in a stream of dry inert gas and for impinging the mixture onto a textile material, said means including at least one tube in communication with the receptacle, a nozzle fitted to one end of the tube and means fitted to the other end of the tube for supplying dry inert gas thereto, whereby a stream of mixed inert gas and dyestuff vapor may be discharged through the nozzle in the form of a jet; and means for supporting a textile material in the path of the jet so that the jet impinges on the textile material.

* * * * *